US007926694B2

(12) United States Patent
Franco

(10) Patent No.: US 7,926,694 B2
(45) Date of Patent: Apr. 19, 2011

(54) APPARATUS FOR VERTICALLY MANUFACTURING POLES AND COLUMNS

(76) Inventor: Enrique Franco, Mexico (MX)

( * ) Notice: Subject to any disclaimer, the term of this patent is extended or adjusted under 35 U.S.C. 154(b) by 654 days.

(21) Appl. No.: 11/545,877

(22) Filed: Oct. 11, 2006

(65) Prior Publication Data

US 2007/0107366 A1 May 17, 2007

Related U.S. Application Data

(60) Provisional application No. 60/726,890, filed on Oct. 14, 2005, provisional application No. 60/755,037, filed on Dec. 30, 2005.

(51) Int. Cl.

| | |
|---|---|
| ***B23K 37/00*** | (2006.01) |
| ***B25B 27/14*** | (2006.01) |
| ***B23K 9/00*** | (2006.01) |
| ***B21J 13/08*** | (2006.01) |

(52) U.S. Cl. ..... 228/44.3; 228/47.1; 29/281.1; 219/59.1; 219/161

(58) Field of Classification Search ..... 228/212, 228/213, 4.5, 44.3, 44.5, 47.1–49.3; 219/59.1–61.6, 219/72, 73, 73.1, 136, 137 R, 158, 161, 159; 212/175, 176; 29/281.1

See application file for complete search history.

(56) References Cited

U.S. PATENT DOCUMENTS

| | | | | | |
|---|---|---|---|---|---|
| 1,762,815 | A | * | 6/1930 | Gloeser | 264/228 |
| 1,952,217 | A | * | 3/1934 | Patton et al. | 228/213 |
| 2,638,524 | A | * | 5/1953 | Meyer | 219/126 |
| 3,068,351 | A | * | 12/1962 | Longenecker et al. | 219/125.1 |
| 3,241,229 | A | * | 3/1966 | Turbett | 228/212 |
| 3,927,770 | A | * | 12/1975 | Rekawek | 414/745.2 |
| 4,064,616 | A | * | 12/1977 | Kubota et al. | 29/429 |
| 4,068,359 | A | * | 1/1978 | Bunker | 29/33 K |
| 4,230,255 | A | * | 10/1980 | Coulter | 228/184 |
| 4,371,108 | A | * | 2/1983 | Roggendorff et al. | 228/173.6 |
| 4,435,242 | A | * | 3/1984 | McNulty | 156/264 |
| 4,523,076 | A | * | 6/1985 | Laymon | 219/125.1 |
| 4,562,950 | A | * | 1/1986 | Fuller | 228/170 |
| 4,632,617 | A | * | 12/1986 | Pechacek et al. | 414/10 |
| 4,639,574 | A | * | 1/1987 | Arnoldt et al. | 219/125.1 |
| 4,744,499 | A | * | 5/1988 | Johnson et al. | 228/4.1 |
| 4,835,359 | A | * | 5/1989 | Sciortino | 219/121.59 |
| 5,199,147 | A | * | 4/1993 | Whiteside | 29/281.1 |
| 5,226,583 | A | * | 7/1993 | Imashimizu et al. | 228/182 |
| 5,307,979 | A | * | 5/1994 | Kim | 228/32 |
| 5,662,264 | A | * | 9/1997 | Gustafsson et al. | 228/170 |

(Continued)

FOREIGN PATENT DOCUMENTS

| | | | |
|---|---|---|---|
| JP | 62234669 | A * | 10/1987 |

(Continued)

*Primary Examiner* — Kiley Stoner
*Assistant Examiner* — Carlos Gamino

(57) ABSTRACT

The present invention refers to an apparatus and method that allows manufacturing of steel poles and honeycomb columns. It consists of placing previously cut strips of steel in vertical position with a set of top and bottom clamping devices to form a steel tapered pole. The strips of steel are welded together, to form a steel pole or honeycomb column, with a slideable welding device mounted on a ascending and descending moving welding platform. The moving welding platform moves to the top position, the top clamping device is liberated and the finished pole or honeycomb column is tilted 90 degrees to the front of the machine by a hydraulic cylinder that tilts the extraction platform. The finished pole or honeycomb column is positioned in the extraction bed and the bottom clamps release the pole.

8 Claims, 13 Drawing Sheets

U.S. PATENT DOCUMENTS

| | | | | |
|---|---|---|---|---|
| 5,673,843 | A * | 10/1997 | Gainey | 228/44.5 |
| 6,234,383 | B1 * | 5/2001 | Harmat et al. | 228/254 |
| 6,439,449 | B1 * | 8/2002 | Gelfman | 228/121 |
| 6,481,096 | B2 * | 11/2002 | Lehmker et al. | 29/721 |
| 6,513,789 | B2 * | 2/2003 | Kimura et al. | 254/89 H |
| 6,629,354 | B1 * | 10/2003 | Kline | 29/559 |
| 6,775,897 | B2 * | 8/2004 | Wolf et al. | 29/464 |
| 7,434,718 | B2 * | 10/2008 | Wirth | 228/44.5 |
| 2003/0024918 | A1 * | 2/2003 | Offer et al. | 219/137 R |
| 2006/0138090 | A1 * | 6/2006 | Franco | 219/60.2 |
| 2007/0151089 | A1 * | 7/2007 | Franco | 29/452 |

FOREIGN PATENT DOCUMENTS

| | | | |
|---|---|---|---|
| JP | 01053778 | A * | 3/1989 |
| JP | 01218770 | A * | 8/1989 |
| JP | 10264990 | A * | 10/1998 |

* cited by examiner

APPARATUS FOR VERTICALLY MANUFACTURING POLES AND COLUMNS

This application is based upon and claims priority from U.S. Provisional application Ser. Nos. 60/726,890 and 60/755,037, which are incorporated herein by reference.

BACKGROUND OF THE INVENTION

1. Background Information

The "Apparatus, System and method, that permits the manufacturing of steel poles and steel honeycomb columns", produces steel poles and steel honeycomb columns.

Steel poles and honeycomb columns are cylindrical structures that can be built in many different lengths, diameters and sizes, depending on the type of application for which they will be used.

Poles and honeycomb columns are made with high-strength, low-alloy steel conforming to ASTM (American Society for Testing and Materials). Trapezoidal or triangular steel plaques are welded to form a multi-sided cylindrical structure. Welding should comply with the American Welding Society (AWS) standards. Poles normally have a finishing coating to protect them from corrosion; the different types of finishes are galvanizing, painting or self-weathering.

Steel poles and honeycomb columns are designed in accordance with industry standards and/or end user specifications. The most common industry standards are ASTM, AWS and American Society of Civil Engineers (ASCE) standards.

Steel poles require far less land and have less foundation costs than other tower types. Moreover, poles require less maintenance because they have practically no associated hardware (bolts, screws, angles). They are better looking and less obtrusive structures in the skyline than other tower types.

Steel poles and honeycomb columns can be used in a wide range of applications. Normal markets for these poles are:

- Traffic and lighting. This segment includes all the structures to which lighting and traffic control structures are attached for a wide range of applications: streets, highways, parking lots, commercial and residential developments. Area lighting structures range in height from 90 to 150 feet; traffic structures range
- Power transmission. Steel poles can be used by utilities to transmit and distribute electricity to their customers. Power transmission poles can be divided into transmission, sub transmission and distribution poles depending on the voltage they carry. Transmission poles could carry 115 to 400 kilovolts (kV); sub transmission poles normally carry voltage in the 69 to 138 kV range, and distribution poles in the 13.8 to 34.5 kV range.
- The difference between each one of these poles is the height of the structure and the type and size of attachments, special equipment mounting brackets and other accessories. The difference between each one of these poles is the height of the structure and the type and size of attachments, special equipment mounting brackets and other accessories.
- Telecommunications. In the telecoms industry, poles are used to support cellular transmitter and receiver devices. These structures range in height from 30 to 1000 feet. These structures should be designed to meet customer specifications and site factors, which include the number of antennas on the structure, wind and soil conditions or geographical location. Due to the size of these structures, engineering and design procedures are extremely important factors to ensure that each structure meets performance and safety specifications.

- Wind Power. Wind power structures generate electricity by harnessing the wind. These structures are composed of a wind turbine and the generator equipment. The wind turbine is mounted over a steel pole. These poles are wider in diameter and have an elliptic shape to provide adequate support against wind speeds. The steel used in these structures is thicker than in the other applications.
- High-rise Buildings. In the construction of high-rise buildings, columns are used as part of the structure to support the floors of the building. These columns should be designed to meet customer specifications and local building codes.
- Bridges. The bridge structure is mounted on steel columns to support the structure in the air to clear the pass way of the bridge. The columns should be designed to comply with all engineering codes that apply to the construction of the bridge.

Steel poles, and steel honeycomb columns offer a variety of possibilities to end users:

- Flexibility. Steel poles can be custom designed to support larger and heavier loadings with longer spans between structures, as well as meet greater height requirements. This means fewer poles to purchase and install. Industries that benefit: Utilities.
- Less steel. Steel honeycomb columns, use less steel to support a load. The honeycomb structure permits the reduction of the thickness of the steel used in a steel column. Industries that benefit: High Rise Buildings and Bridges.
- Easy-to-Use. The poles can be pre-drilled to accommodate special customer framing requirements and most existing hardware can easily be used on steel structures. Industries that benefit: Utilities, Lighting and Traffic.
- Environmental: Steel poles comply with EPA regulations. Steel poles are non-toxic and recyclable, reducing disposal problems and costs. Industries that benefit: Utilities, Lighting and Traffic, Telecommunications.
- Maintenance: Less hardware (bolts, screws) means less maintenance work to do. Steel is not susceptible to damage by external factors (animals, fires) like concrete or wood poles. Industries that benefit: Utilities.
- Lead Time. Manufacturing time for poles is lower than for other types of structures meaning faster time to deploy; installation time is also lower thus saving labor costs. Industries that benefit: Utilities, telecommunications.

There are two broad segments where this development could be a meaningful advance.

- Steel Pole and Honeycomb column Consumers. The consumers of these poles are the same that were mentioned in section Background of this document. They can get the following benefits:
  - Lower Pole and column Manufacturing Costs. The cost saving advantages of the process might push manufacturers to lower their pole prices in benefit of end users.
  - Lower lead time. The reduced lead time for the machinery allows manufacturers to start producing faster than before and cope with seasonal peaks of demand for the poles. Consumers won't have delays in the delivery of their goods.
- Steel Pole Manufacturers. Pole manufacturers could get many advantages from this development:
  - Lower investment in plant and equipment
  - Faster time to start production (meaning faster return on investment)

Another application for this development is the following:

Structural applications. This development might be used to manufacture special tubes and piping for structural applications.

2. Description of the Prior Art

The normal manufacturing process of steel poles comprises the following steps.

Steel plates are fed directly into CNC (Computer Numerical Control) controlled plasma burning equipment and cut to the required dimensions. The shape and measurements of this piece are designed accordingly with the application of the finished pole.

The cut piece is then fed into a large break press. The piece of sheet metal is formed along a straight axis. The resultant piece might be a "V"-shaped, "U"-shaped, or semi cylindrical shaped piece. The type of shape is determined by the punch and die set of the press.

Two or more of these semi cylindrical shapes are welded together to produce a complete cylindrical structure. Components should be pre-heated according to AWS code parameters and then welded either with MIG (metal in gas welding by micro wire) or submerged arc devices.

After welding, and depending on the choice of finish, poles could be coated with urethane powder, painted or galvanized. Galvanized is the most common finish for these structures.

SUMMARY OF THE INVENTION

The present invention refers to an apparatus and method that provides for the manufacturing of steel poles and honeycomb columns. It consists of placing previously cut pole strips, generally made from steel, aluminum or other similar materials, in a vertical position with a set of top and bottom clamping devices to form a steel tapered pole. The pole strips are welded together, to form a steel pole or honeycomb column, with a slide able welding device mounted on a ascending and descending moving welding platform. The moving welding platform moves to the top position, the top clamping device is liberated and the finished pole or honeycomb column is tilted 90 degrees to the front of the machine by a hydraulic cylinder that tilts the extraction platform. The finished pole or honeycomb column is positioned in the extraction bed and the bottom clamps release the pole.

The present manufacturing method has the following advantages:

Less investment in machinery. This new apparatus and manufacturing process doesn't require some of the machines used in the traditional pole manufacturing industry. These machines are replaced by this new apparatus at a lower cost.

Less investment in plant. Traditional process for pole manufacturing requires large foundation works to place the press brakes. The new machinery saves costs in plant construction since its foundation is smaller.

Lead time. Normal lead time for traditional break press ranges from 12 to 15 months; lead time for the new machinery is 3 to 6 months. This reduced lead time translates into a faster return on investment since production can begin earlier.

The resultant pole from the invention has the same structural behavior as the tapered pole from the break press process.

The resultant honeycomb column from the invention uses less steel to support a load compared to a regular steel column.

The "Apparatus"

The Apparatus is comprised of: an "apparatus to hold and position the strips of steel," an "apparatus to weld the strips of steel" and an "apparatus to extract the steel tapered pole".

The "Apparatus To Hold And Position"

The apparatus to hold and position is comprised of: a "tension positioning apparatus", a moving bridge and an extraction platform.

The "tension positioning apparatus" is comprised of: a top head (mounted under the moving bridge), a bottom head (mounted on the extraction platform), two sets of clamping devices (top and bottom clamps), two sets of horizontal positioning devices (top and bottom), a tensing support (hydraulic cylinder) and a fixed tension support (foundation of the apparatus). This "tensing positioning apparatus" holds and positions the strips of steel at the top and at the bottom.

The clamping device is comprised of: clamps and hydraulic cylinders. With hydraulic pressure the device clamps the strips of steel to hold them in a fixed position. This device is mounted on the horizontal positioning device. The top clamps have a tensing support (hydraulic cylinder) that applies tension to the strips of steel. The bottom clamps are mounted on the extraction platform that is anchored to the fixed tension support (foundation of the apparatus) to hold the tension of the strips of steel.

The horizontal positioning device is comprised of: slide able base, a linear guide and a servomotor. The clamping device is mounted on the slide able base, which slides into position on the linear guide with the servomotor.

The moving bridge is comprised of: Hydraulic brakes, servomotor, gears, counterweights, clamping device and a horizontal positioning device. The clamping device is mounted on the horizontal positioning device in the bottom part of the bridge to hold from the top the strips of steel. The hydraulic brakes on each side of the bridge are comprised of four hydraulic pistons that apply pressure to two sides of the two columns to hold the moving bridge in position. The servomotor is connected to the gears that are positioned on the rack that is on the column. The counterweights are connected with a cable to the moving bridge to ease the weight on the servomotors. The servomotors ascend or descend the moving bridge into position.

The extraction platform is comprised of: Hydraulic cylinder, a clamping device and a horizontal positioning device. The clamping device is mounted on the horizontal positioning device. Both devices are mounted on the top of the extraction platform to hold from the bottom the strips of steel in position. The hydraulic cylinder holds the extraction platform in place during welding, after welding the hydraulic cylinder tilts 90 degrees the platform to extract the finished steel tapered pole.

The "Apparatus To Weld"

The apparatus is comprised of: a moving welding platform, a welding device and a horizontal positioning device.

The welding device is comprised of: welding wire, welding torch, flexible torch holder and a torch cooler.

The horizontal positioning device is comprised of: slide able base, a linear guide and a servomotor. The device to weld is mounted on slide able base, which slides into position on the linear guide with the servomotor.

The moving welding platform is comprised of: a welding device, a device to position, a servomotor, gears, cable holders and counterweights. The welding device is mounted on the horizontal positioning device and both are mounted on the moving welding platform. All cables and pipelines are rolled up and down into position on the flexible cable holders. The servomotors are connected to the gears that are positioned on the racks that are on the columns. The counterweights are connected with a cable to the moving welding platform to ease the weight on the servomotors. The servomotors ascend or descend the moving welding platform during welding.

The "Apparatus To Extract"

The apparatus is comprised of the extraction platform and the extraction bed.

The extraction platform is comprised of: Hydraulic cylinder, a clamping device and a horizontal positioning device. The clamping device is mounted on the horizontal positioning device. Both devices are mounted on the top of the extraction platform to hold from the bottom the strips of steel in position. The hydraulic cylinder holds the extraction platform in place during welding, after welding the hydraulic cylinder tilts 90 degrees the platform to extract the finished steel tapered pole.

The extraction bed is comprised of: base, pulleys, servomotors and steel cable. The cable goes through a series of pulleys that are placed on the sides of the base to form a steel cable net, the servomotors hold the end of the cable and tense the cable into position to receive the steel tapered pole that is being tilted by the extraction platform. The counterweights ease the load on the servomotors.

The "Method"

Pole strips are cut with a plasma cutting torch into an elongated trapezoid shape. The pole strips are generally flat metallic strips, and can be made from a variety of materials. Once all of the pole strips are prepared, they are placed in the apparatus with a hoist.

The moving bridge is positioned at the level to receive the strips of steel. The clamps are opened to receive the strips of steel in the top and the bottom. Once all pole strips are in position, the electro valve actuates the hydraulic cylinders to close all the clamps and hold them in place. The hoist is removed and the horizontal positioning device slides inward the clamps with the strips of steel to form a steel pole or honeycomb column.

When all strips of steel have their final position in the vertical and the horizontal, the electro valve actuates hydraulic brakes of the moving bridge to hold it in position. The electro valves that actuate the "tension positioning apparatus" are actuated and tension is applied to the strips of steel through the tensing support (hydraulic cylinder) in the top clamps. The tension positioning apparatus incorporates a top assembly and a bottom assembly, which in conjunction with each other from opposite sides of any attached pole strip(s) in order to position, place tension upon, and hold the pole strip (s) in place for pole construction.

It is anticipated that each clamping device will incorporate a multiplicity of clamps, each removably attachable to an end of a pole strip so that multiple pole strips may be attached to the top and bottom assemblies concurrently. The multiplicity of clamps allow the pole strips are placed edge to edge in a polygonal and generally circular configuration (as shown in FIG. 11B) so that the pole strips may be joined to from a pole. It is generally anticipated that the poles will be polygonal and generally circular in shape, but it is anticipated that other shapes could be created as well. For example, in a certain circumstance, an air-foil shaped pole may be advantageous. Such a pole could be created using the current invention by arranging the clamps in the appropriate configuration.

The tensioning device is used to pull such that vertical tension is placed upon the attached pole strip(s). There are a number of means and devices that may be employed as the tensioning device, including without limitation, motorized devices that employ connectors such as rope, chain, cables, rods, or other like elements to attach to the top head, screw devices, hydraulics, counter-weights, pulley systems, levers, and like systems. It is anticipated that there will be at least one positioning device associated with the tension positioning apparatus. Generally, it is anticipated that a top positioning device will be employed, however both a top positioning device and a bottom positioning device may be used, or just a bottom positioning device. The positioning devices provide generally horizontal positioning for the associated clamping device and any attached pole strip(s), or more accurately horizontal movement in relation to a longitudinal axis running lengthwise through the pole strips. Pole strips are mounted to the clamping devices on the top and bottom heads. The top positioning device (or bottom positioning device if same is employed) is moved to adjust the final horizontal position of the pole strip. Once all of the pole strips are in horizontal position, tension is applied by the tensioning device in an outward direction along the longitudinal axis, transmitting tension to the pole strips.

When all of the pole strips are tensioned and in their final position, they can be welded or otherwise joined in order to manufacture a pole. It is anticipated that poles manufactured will be constructed in parallel with gravitational pull, or perpendicularly to the ground, thus the top assembly will be vertically oriented as to the bottom assembly. This vertical orientation virtually eliminates "bowing" of the pole strips that may occur when they are assembled horizontally. It is anticipated however that such vertical positioning would be unnecessary if the tension positioning device was being employed to manufacture poles in a zero gravity environment.

The moving welding platform moves into the corresponding vertical position, the horizontal positioning device slides the torch inward in between the strips of steel.

The collapsible door of the building is closed, the welding torches are ignited and the welding process begins. The servomotors move the moving welding platform upward to weld all the strips of steel. Simultaneously, the servomotors in the horizontal positioning device, adjust the welding torch to the taper of the steel pole or honeycomb column throughout the welding process.

Once the welding is finished, the collapsible door is; opened and the moving welding platform is moved to the up most position to extract the pole.

The steel pole is liberated from the top by releasing the pressure in the hydraulic cylinder that holds the top clamps on the moving bridge. The hydraulic cylinder in the extraction platform is actuated and the pole tilts 90 degrees to rest on the cable net on the extraction bed. Once the pole is resting on the cables, the servomotors are actuated to tense the cable and receive the load of the steel tapered pole. When the load is transmitted to the cable, the hydraulic pressure is relieved from the clamps on the extraction platform, and the pole is released.

The steel pole is removed from the extraction bed with a crane.

DETAILED DESCRIPTION OF THE PREFERRED EMBODIMENT

In the detailed description, the apparatus elements are referenced as:

| Description | Reference No. |
|---|---|
| first support column | 10 |
| second support column | 12 |
| vertical column rack | 14 |
| servomotor | 16 |
| gear | 18 |
| linear guide | 20 |
| column counterweight | 22 |
| cable | 24 |
| pole strip | 26 |
| moving welding platform | 28 |
| support | 29 |
| tension positioning device | 30 |
| welding positioning device | 31 |
| moving bridge | 32 |
| clamp hydraulic cylinder | 34 |
| clamp | 36 |
| hydraulic brakes | 38 |
| welding torch | 40 |
| welding wire | 42 |
| flexible torch holder | 44 |
| torch cooler | 46 |
| welder rack | 48 |
| extraction platform | 50 |
| extraction platform hydraulic cylinder | 52 |
| control panel | 54 |
| working platform | 56 |
| servomotor movement control panel | 58 |
| servomotor power amplifier control panel | 60 |
| counterweight pulleys | 62 |
| fixed cable holder | 64 |
| building | 66 |
| first flexible cable holder | 68 |
| second flexible cable holder | 70 |
| electrical power panel | 72 |
| entryway | 74 |
| bed counterweight | 76 |
| bed pulley | 78 |
| rail | 80 |
| bed cable | 82 |
| wheel | 84 |
| bed servomotor | 86 |
| extraction bed | 88 |
| extraction bed unit | 90 |
| hinge | 92 |
| pole or column | 100 |

Figure 1:
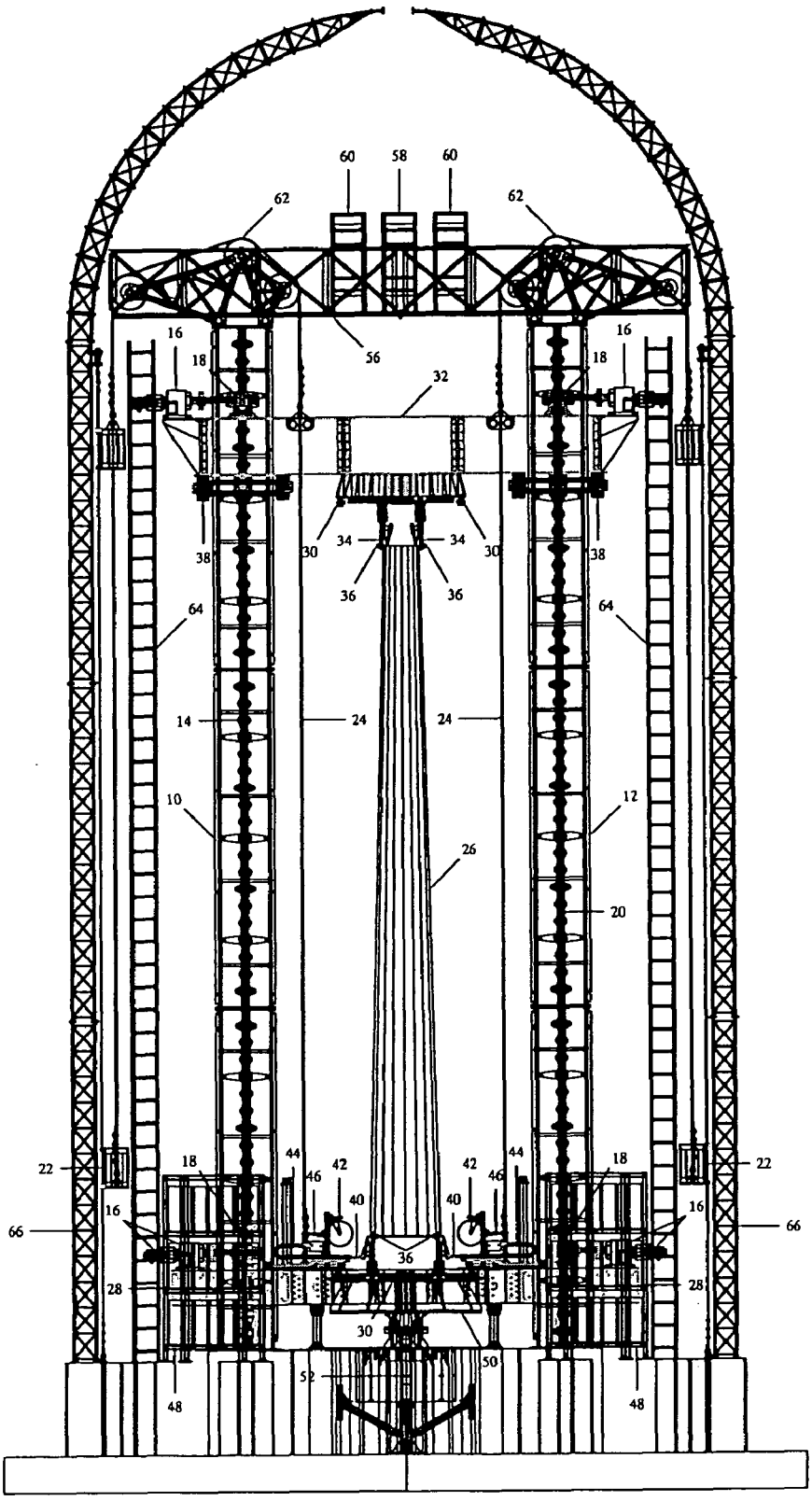
FIG. 1. is a front view of the apparatus with a pole in place.

Referring to the figures, FIG. 1. is a front view of the apparatus shown with pole strips (26) mounted in the tension positioning device (30). The tension positioning device (30) is comprised of: a top head (not shown) (mounted under the moving bridge (32)), a bottom head (not shown) (mounted on the extraction platform (50)), two sets of clamping devices (36) (top and bottom clamps), two sets of positioning devices (30) (top and bottom), a clamp hydraulic cylinder (34) and a fixed tension support (foundation of the apparatus). Those pieces located at the top, or first end, of the apparatus are referred to as the top tensioning device, while those pieces located at the bottom, or second end, of the apparatus are referred to as the bottom tensioning device.

In order to support the tops of the pole strips (26), a top, or first, holding means (not numbered) is employed. The first holding means (not numbered) is anticipated to be the top portion of the positioning device (30), however any number of similar devices could be employed, the main criteria being the ability to hold the pole strips (26) vertically in the desired orientation. At the bottom, a bottom, or second holding means (not numbered) is employed, and again, a variety of embodiments of the second holding means (not numbered) could be employed so long as it holds the pole strips (26) vertically in the desired orientation.

The top tensioning device (not numbered), or first holding means, is removably attachable to the first ends of a multiplicity of pole strips (26). The number of pole strips (26) is dependent upon the size and configuration of the pole or column to be manufactured and desired by the user. The attachment is accomplished via a number of clamps (36). In the same manner, the bottom tensioning device (not numbered) is removably attachable to the second ends of the pole strips (26) via clamps (36). The clamps (36) maybe aided in their attachment to the pole strips (26) by a clamp hydraulic cylinder (34). The clamp hydraulic cylinder (34) can provide clamping force to the clamps (36) in order to better hold the pole strips (26). The positioning device (30) maybe moved along the x and y axis in the horizontal plane as well as vertically, thereby giving it three degrees of freedom. The movement of the positioning device (30) allows the user to adjust for the length of the pole strips (26) as well as positioning the pole strips (26) so that the edges of the pole strips (26) are in position for attachment or welding.

The moving bridge (32) is in the top position holding the "tension positioning apparatus" in position to form a pole (100). The moving welding platform (28) is in the bottom position. The extraction platform (50) is holding the bottom clamps (36) in position to form a pole (100). The first and second support columns (10 and 12) and the vertical column rack (14) where the moving bridge (32) and moving welding platform (28) ascend and descend are visible on the two sides of the figure. The building (66) may be generally silo shaped, enclosing the apparatus with an arc at the top.

The top tensioning device (not numbered) and the bottom tensioning device (not numbered) are held in a vertical orientation relative to each other by support columns. While it is anticipated that a single support column could be used, it is likewise anticipated that a multiplicity of support columns could also be used. In the preferred embodiment, a first support column (10) and a second support column (12) provide attachment for the top tensioning device (not numbered) and the bottom tensioning device (not numbered). These support columns (10 and 12) also provide the framework and support for much of the remainder of the present invention. A linear guide (20) may provide a pathway for the vertical column rack (14) that runs along these support columns (10 and 12) and provides communication between the controllable elements of the present invention and the user. Cables (24) which are connected to the tops of the support columns (10 and 12) and raise and lower the moving bridge (32). At the tops of the support columns (10 and 12), counterweight pulleys (62), as well as control panels for the servomotors, such as the servomotor movement control panel (58) and the servomotor power amplifier control panel (60), control positioning of the apparatus. The cables (24) are aided in their lifting and lowering of the moving bridge (32) by column counterweights (22). Access along the length of the support columns (10 and 12) to the various components may also be available via fixed cable holders (64). The raising and lowering of the moving bridge (32) as well as the welder rack (48) is powered by servomotors (16). The power from the servomotors (16) are converted and controlled by gears (18).

Once the pole strips (26) are in place held vertically between the top positioning device (not numbered) and the bottom positioning device (not numbered), the moving welding platform (28) which has welding torches (40) mounted on it along with welding wire (42), flexible torch holders (44), and torch coolers (46) all on a welder's rack (48), is raised vertically along the pole strips (26). The welding torches (40) are positioned such that they can weld, or otherwise join, the edges of the pole strips (26). By providing multiple welding torches (40) on the moving welding platform (28) and positioning the welding torches (40) such that they are adjacent to a multiplicity or all of the seams created by the pole strips (26), the time for manufacture of the pole (100) can be reduced.

Below the bottom tensioning device (not numbered) is an extraction platform (50) having an extraction platform hydraulic cylinder (52).

Figure 2:
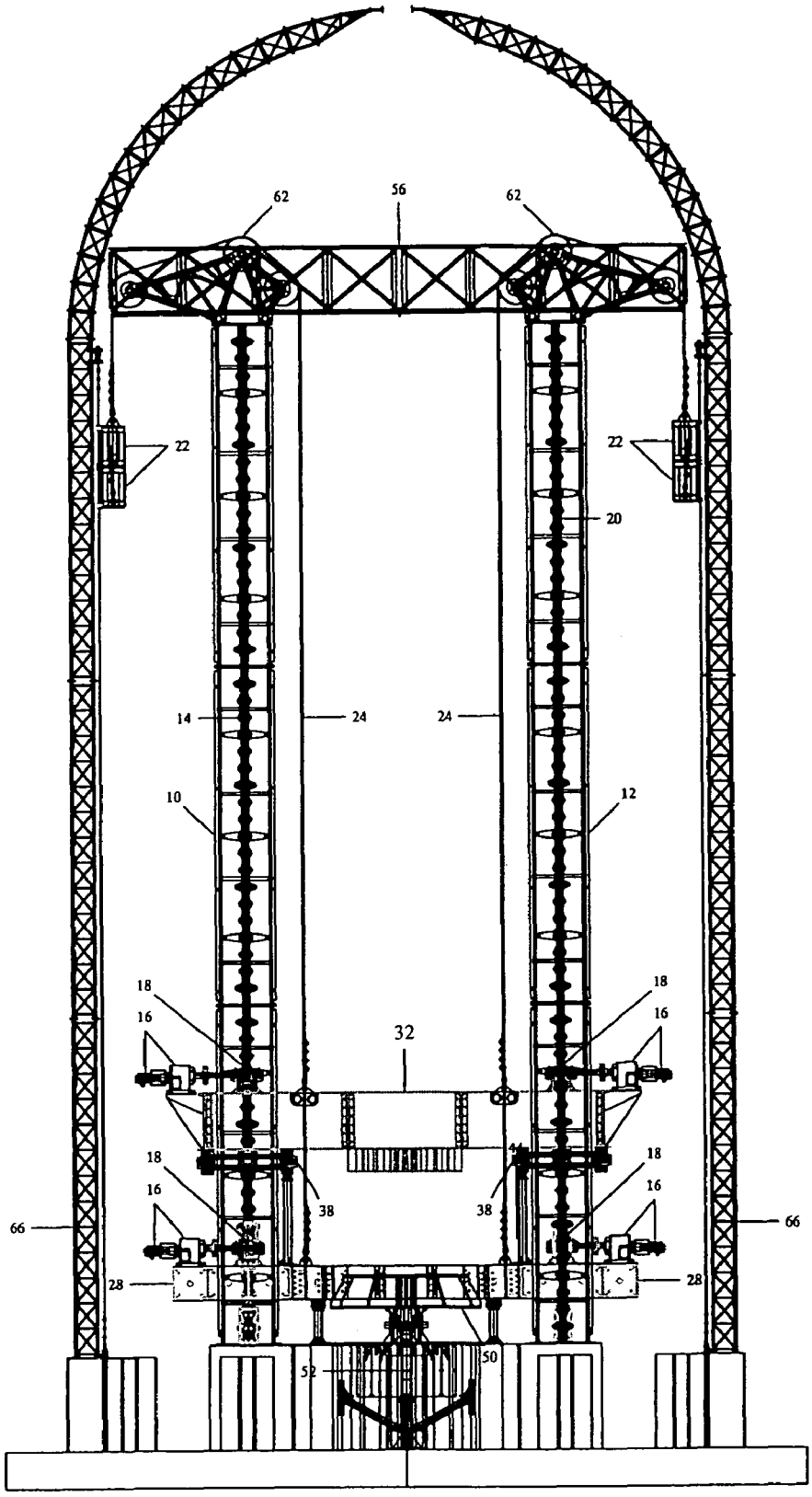
FIG. 2. is a front view of the apparatus.

FIG. 2. is a front view of the apparatus. The moving bridge (32) and the moving welding platform (28) are in the bottom position. The extraction platform hydraulic cylinder (52) is visible under the extraction platform (50). The linear guides (20), vertical column racks (14), gears (18), and servomotors (16) are visible on the support columns (10 and 12). The cable (24) of the column counterweight (22) is visible between the support columns (10 and 12). The column counterweights (22) are in their top positions.

Figure 3:
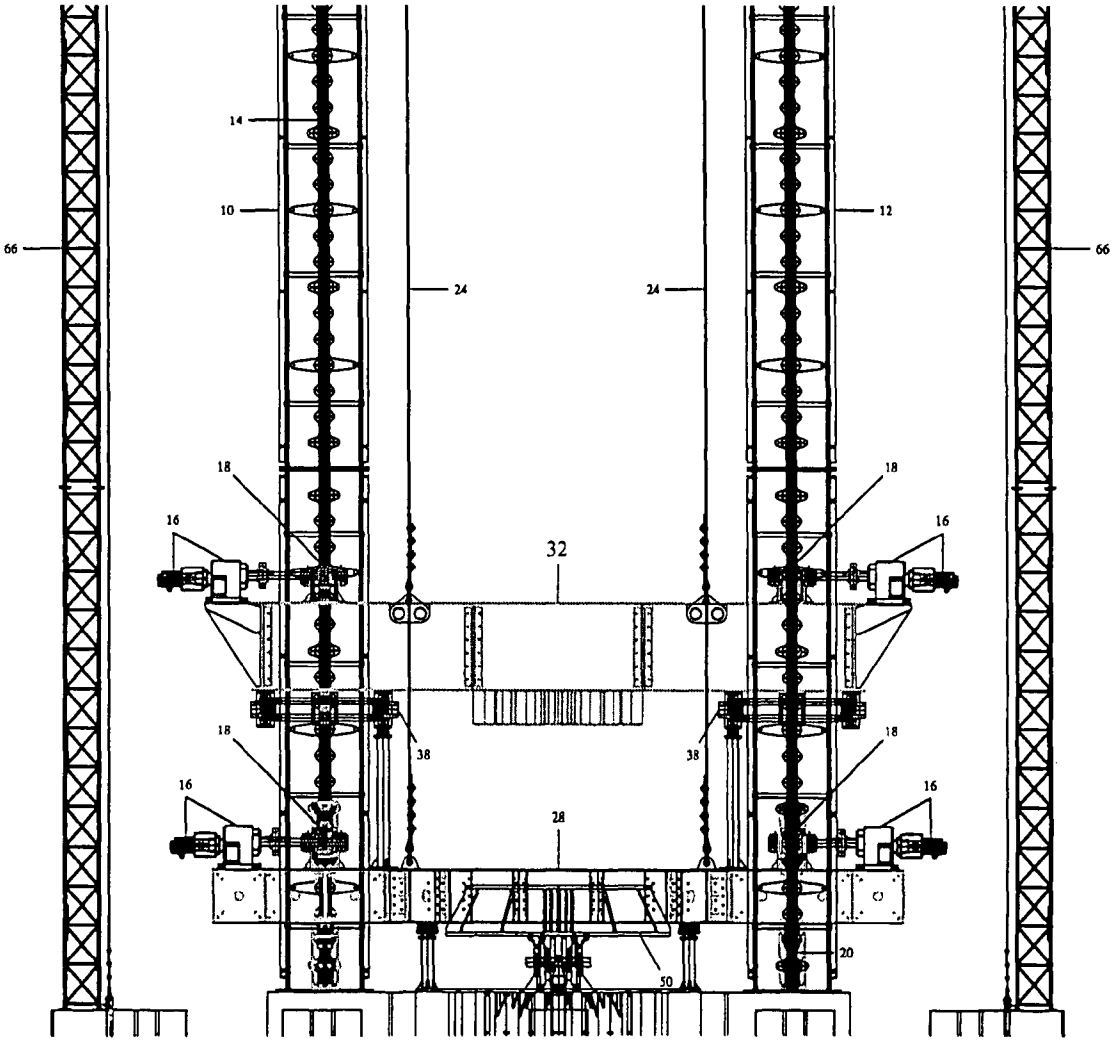
FIG. 3. is a front view of the moving bridge.

FIG. 3. is a front view of the moving bridge (32), the moving welding platform (28), and the extraction platform (50). The hydraulic brakes (38) of the moving bridge (32) are under the moving bridge (32) and attached to the support columns (10 and 12). The vertical column racks (14), gears (18), and servomotors (16) are visible in the figure on both sides of the apparatus. This figure provides a more detailed view of the relationship between the moving bridge (32), the moving welding platform (28), and the extraction platform (50). It can be seen that the moving bridge (32) can be raised and lowered separately from the moving welding platform (28), although they are moved along the same cables (24). Therefore, while moving independently, they move along the same path. The servomotors (16) and gears (18) provide the power and actuation for movement of the moving bridge (32) and welding platform (28).

Figure 4:
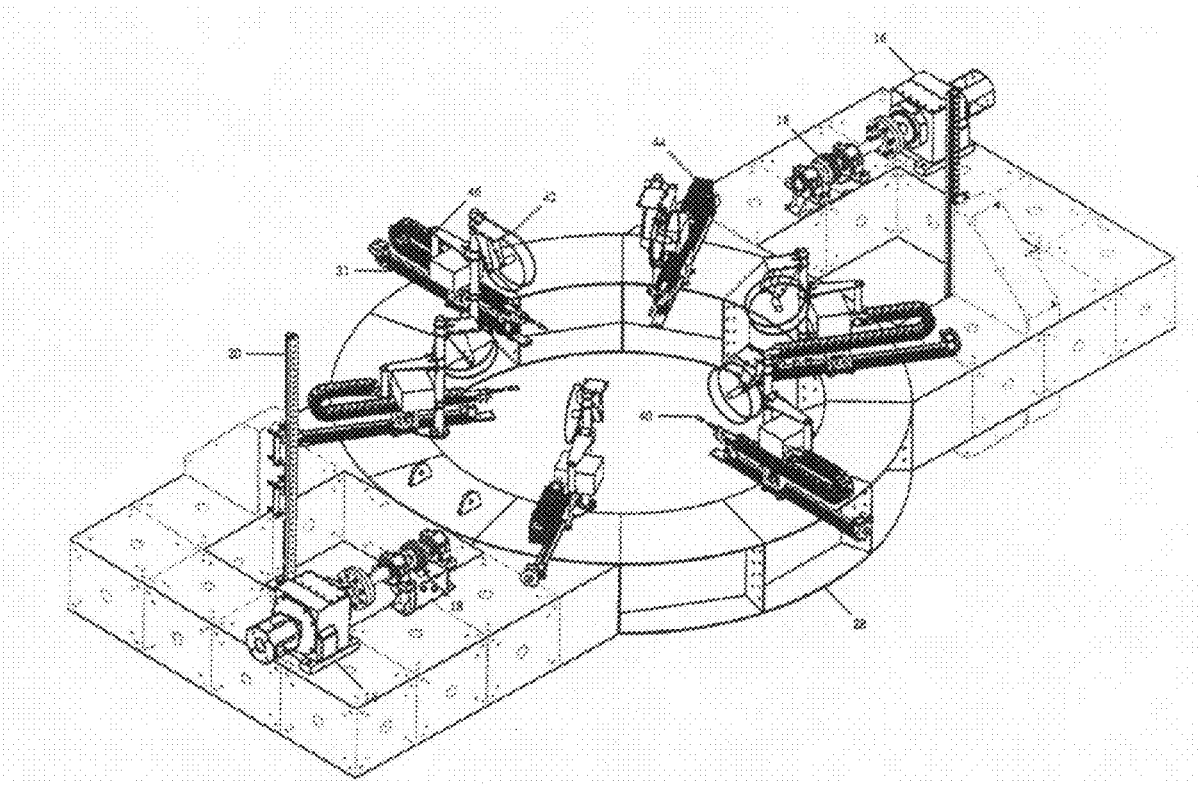
FIG. 4. is a perspective view of the moving welding platform.

FIG. 4. is a perspective view of the moving welding platform (28). The welding torches (40) are mounted on the moving welding platform (28). The welding torch (40), the flexible torch holder (44), the welding wire (42), and the welder positioning device (31) are components of the welding device. The servomotors (16) and gears (18) are mounted on each side of the moving welding platform (28). By positioning the welding torches (40), using the welder positioning device (31), based upon the seams created by the edges of the pole strips (26), multiple welds can be done concurrently therefore reducing the manufacturing time of the poles (100). This figure also better shows how the linear guides (20) help orient the moving welding platform (28).

Figure 5:
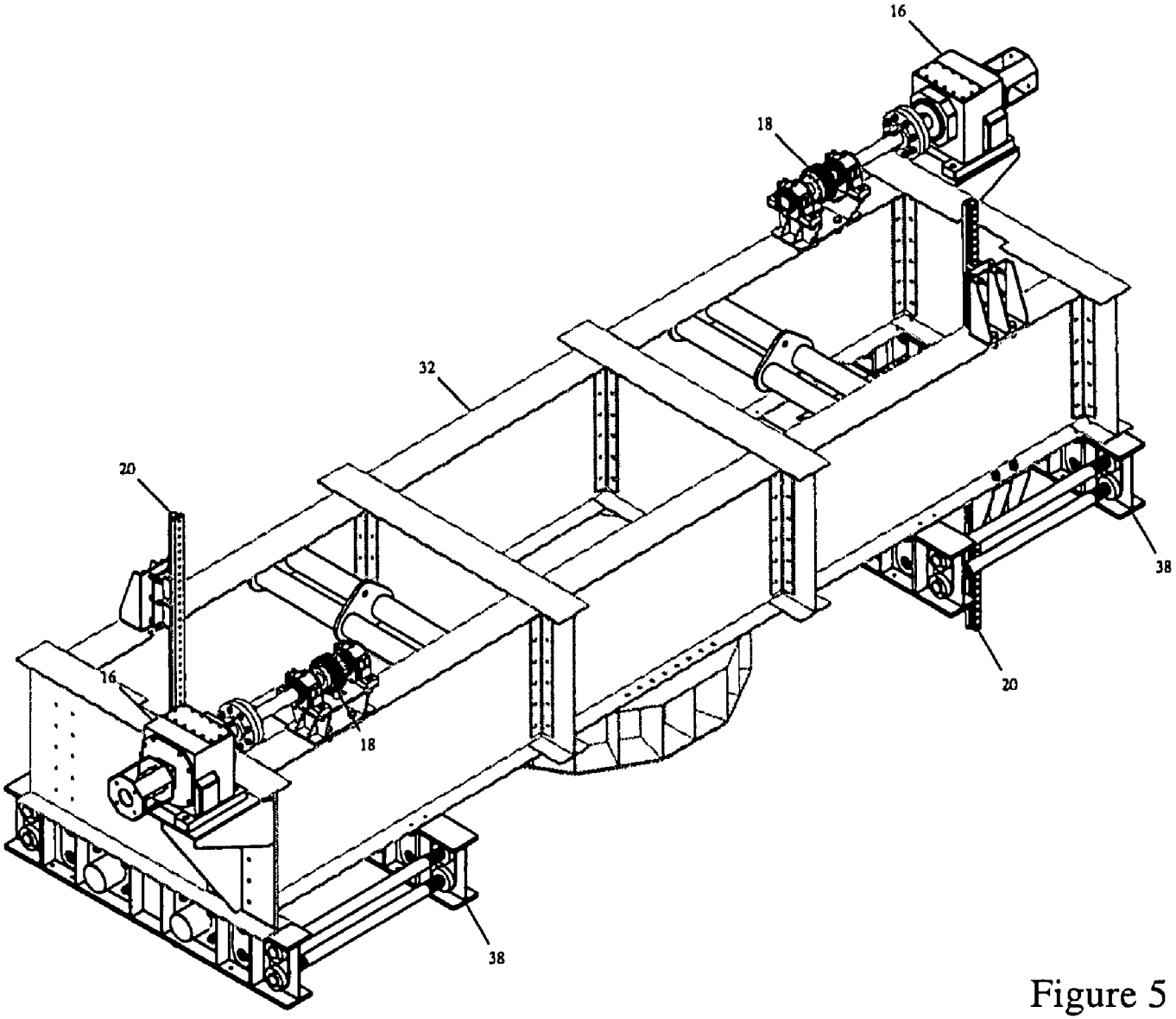
FIG. 5. is a perspective view of the moving bridge.

FIG. 5. is a perspective view of the moving bridge (32). The servomotors (16) and gears (18) are mounted on each side of the moving bridge (32). The cylinders of the hydraulic brakes (38) are mounted on each side of each column (not shown) in the bottom of the moving bridge (32). The polygonal structure in the bottom of the moving bridge (32) is where the clamps (not shown) are mounted to hold the strips (not shown). Here again, the linear guides (20) are shown and the concept of how the linear guides (20) help control the positioning of the moving bridge (32) is illustrated. In an embodiment in which the moving bridge (32) is supported by these cables (24) as the welding platform (28), it is advisable to provide brakes such as the hydraulic brakes (38) below the moving bridge (32) to provide breaking power for the moving bridge (32). In an embodiment in which the moving bridge (32) was supported by separate cables (24) from the moving welding platform (28), the moving bridge (32) could be placed at the end of the cables (24) and hydraulic brakes (38), or brakes of another sort, would not be necessary.

Figure 6:
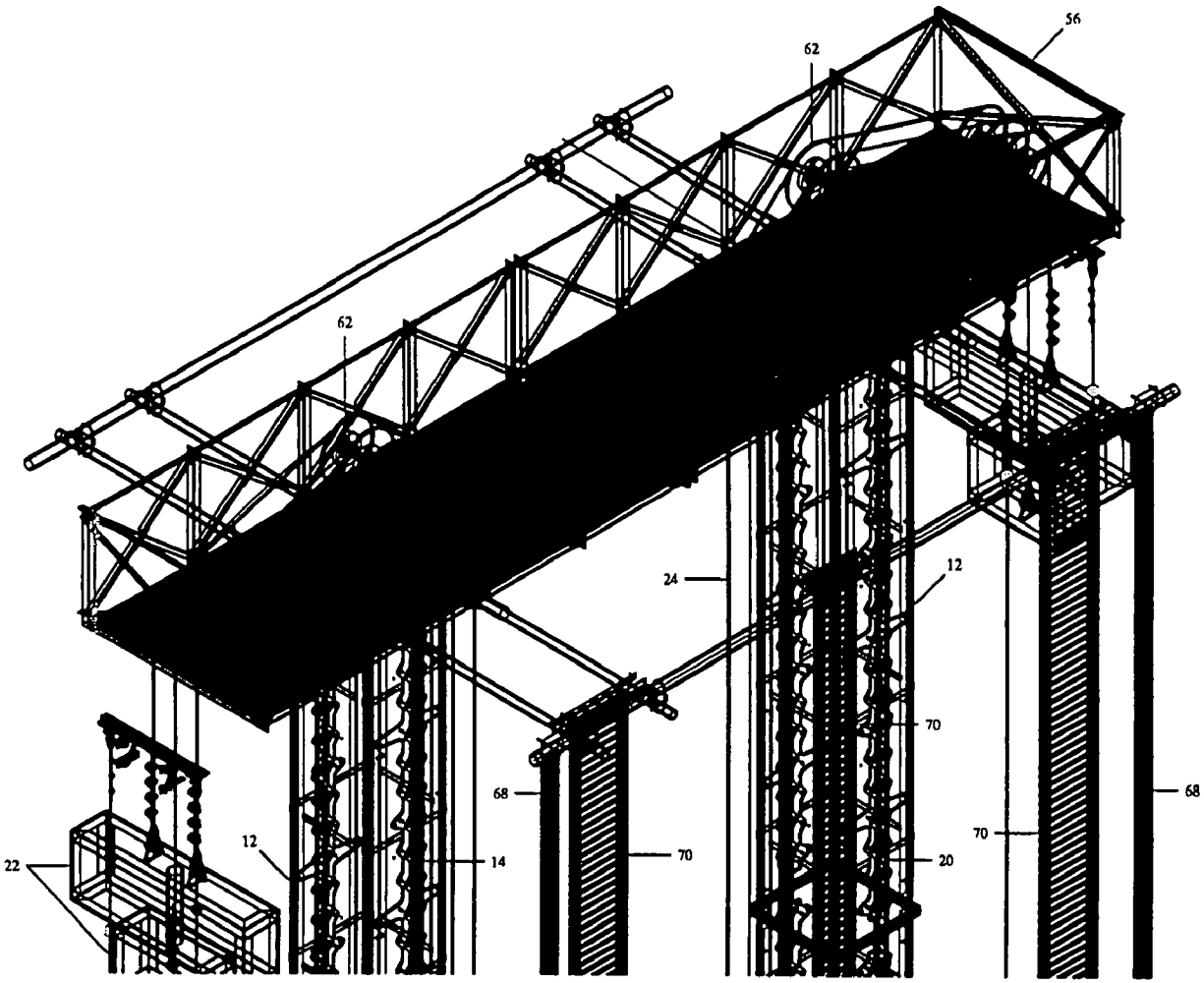
FIG. 6. is a perspective view of the working platform.

FIG. 6. is a perspective view of the working platform (56). The main counterweight pulleys (62) are on both sides of the working platform (56). The first flexible cable holder (68), which can be used for a number of things, such as communications, control, power, gas and hydraulics, are visible on both sides of the apparatus. The working platform (56) provides connection and support at the top of the support columns (10 and 12). It can also provide access for maintenance and work to users at the top of the present invention. It also provides the framework and support for the cables (24) which are suspended from the counterweight pulley (62) and connected to column counterweights (22). In order to provide communication from control elements that may be placed on the working platform (56), such as the servomotor movement control panel (58), the servomotor power amplifier control panel (60), or other like control units, the working platform (56) may provide support for additional cable holders such as the first flexible cable holder (68) and the second flexible cable holder (70) shown in this figure. In one embodiment of the present invention, the first flexible cable holder (68) could provide for communications and control of the invention, while the second flexible cable holder (70) could provide power, gas, and hydraulics. It is anticipated that the number of cable holders (68 and 70) and what the cable holders (68 and 70) provide would be subject to the needs of the users and the design of that specific embodiment of the present invention.

Figure 7:
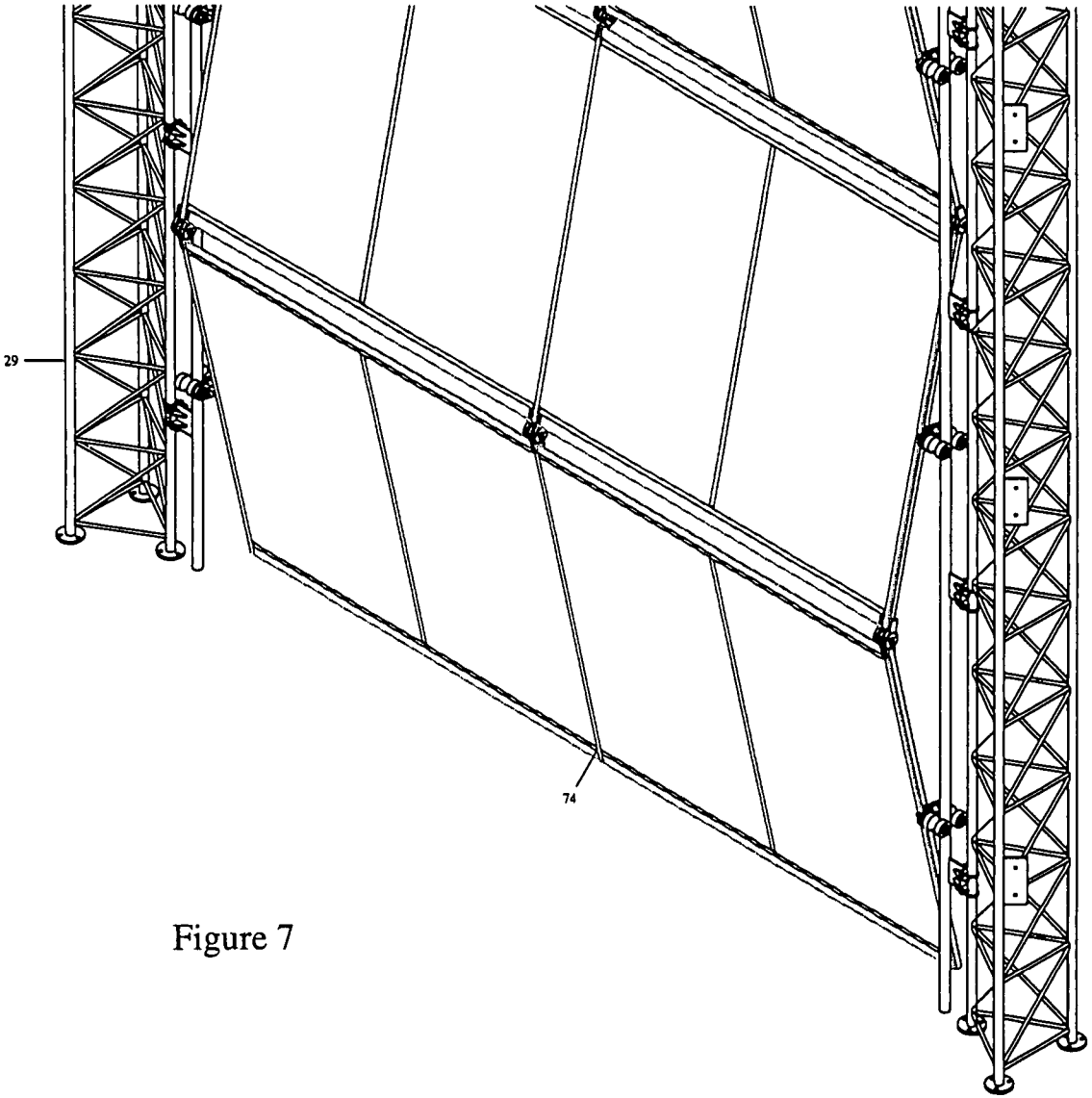
FIG. 7. is a side perspective of the entryway.

FIG. 7. is a side perspective of the entryway (74) of the building (66) that contains the apparatus. While the containment building (66) is unnecessary for the apparatus to be used, the building (66) can provide protection from the elements for the remainder of the apparatus, as well as anchoring and support elements. It is anticipated that the building (66) could be of any size or shape that provides room for manufacture of desired sized poles and columns (100). However, it is anticipated that a stand alone building (66) to house the apparatus and be for the primary use of manufacturing poles and columns (100) would be silo-shaped. Collapsible entryways (74), on supports (29), would provide ingress and egress with the poles and columns (100).

Figure 8:
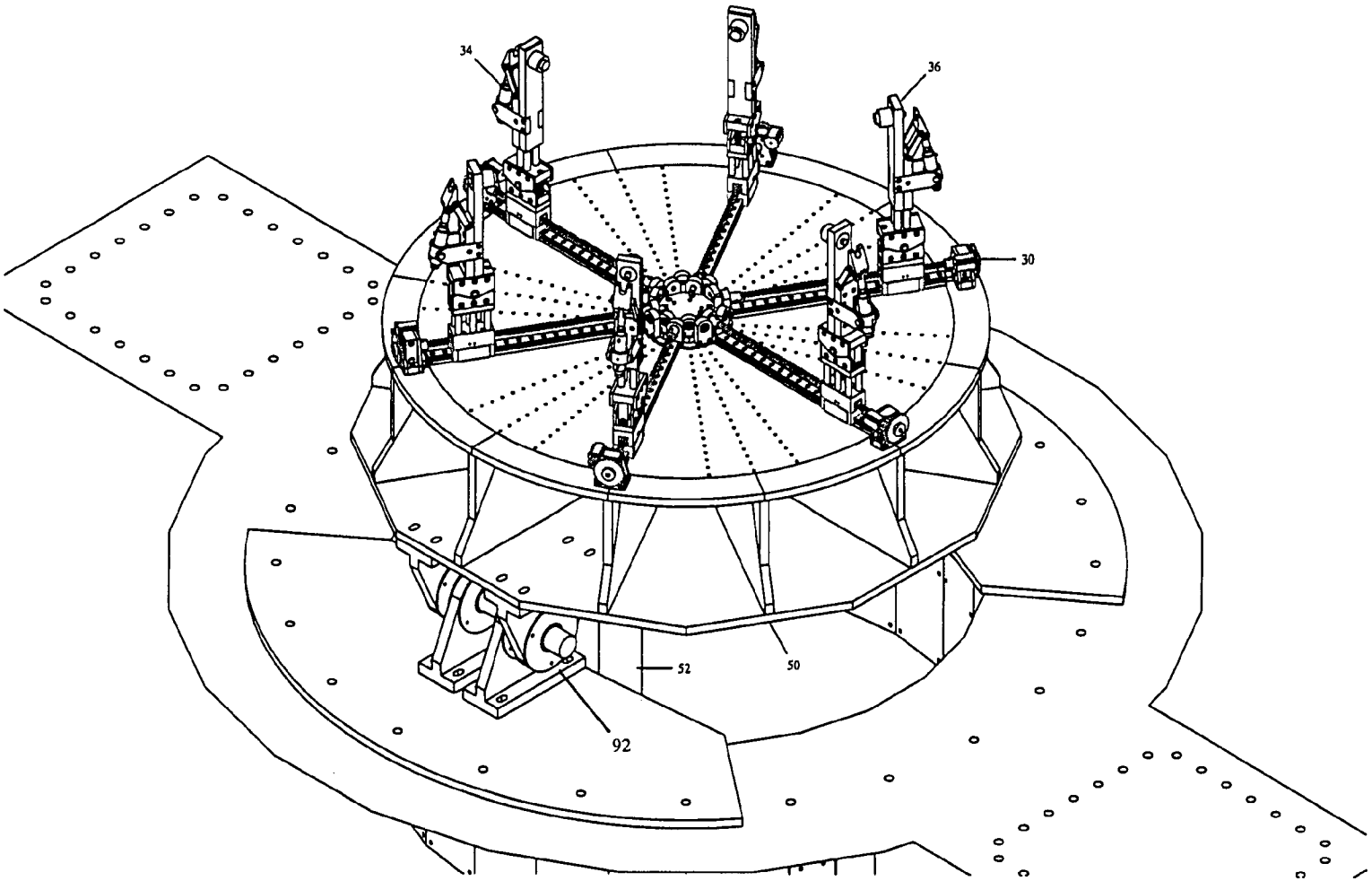
FIG. 8. is a top perspective view of the extraction platform.

FIG. 8. is a top perspective view of the extraction platform (50), the clamps (36) to hold the pole strips (26) which will be joined to form the poles (100) from the bottom are visible, the clamp hydraulic cylinders (34) that actuate the clamps (36) are visible. The positioning device (30) is shown, as well as the extraction platform hydraulic cylinder (52) that tilts the extraction platform (50). The extraction platform (50) is extremely important for removing the pole (100) from the present invention. The rotational capability provided by the hinge (92) and the power provided by the extraction platform hydraulic cylinder (52) allows the pole (100) to be reoriented from a vertical position to a horizontal position for removal from the building (66). The extraction platform (50) allows such removal while reducing possible damage to the pole (100).

Figure 9:
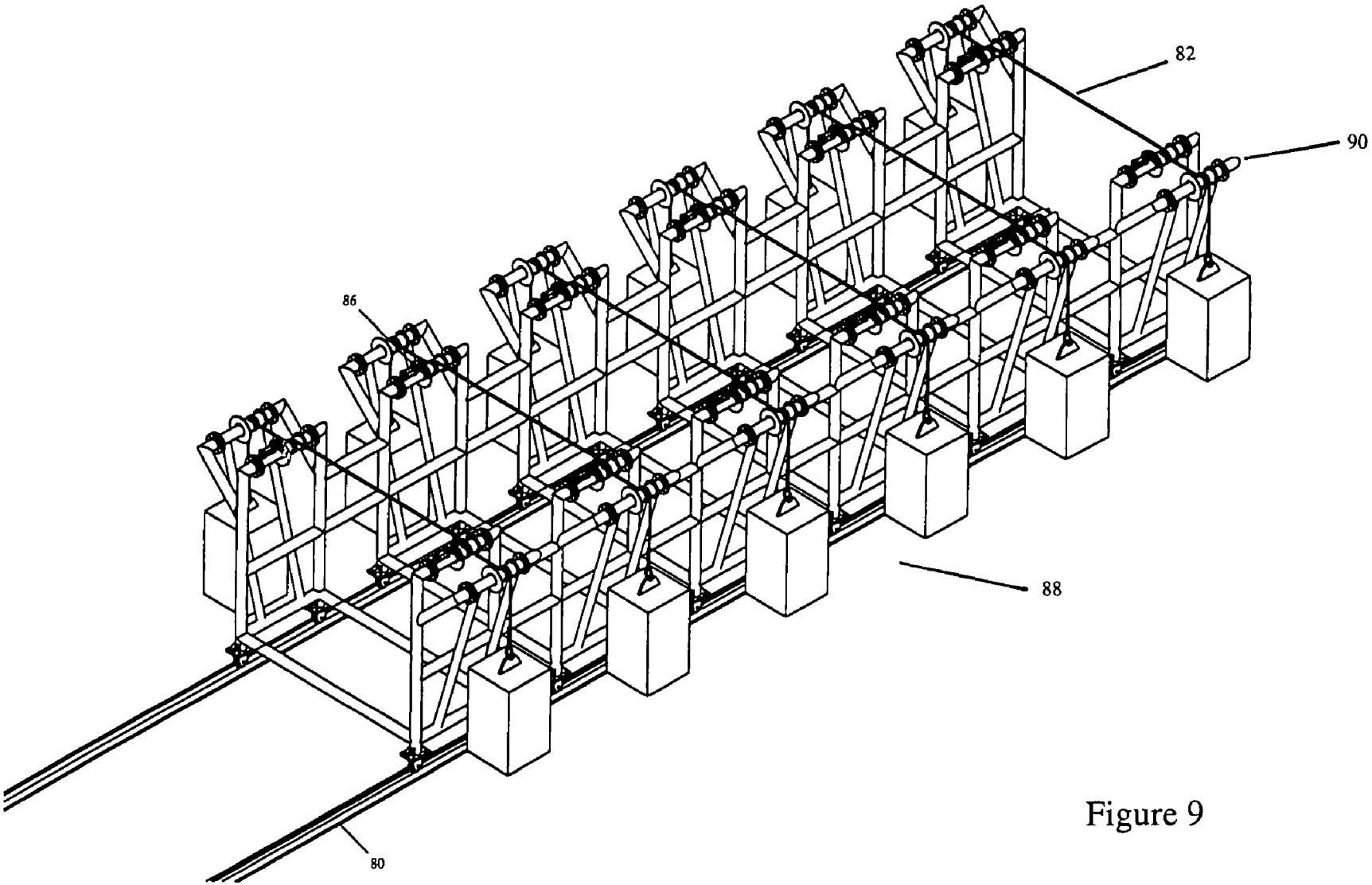
FIG. 9. is a perspective view of an extraction bed.

FIG. 9. is perspective view of a multiplicity of extraction bed units (90) that make up the extraction bed (88). The extraction bed (88) may be mounted on wheels (84) that may be operably connected to rails (80) which allow for easier and more controlled movement of finished, or partially finished, poles and columns (100). The extraction platform (50) (as shown in FIG. 8) layers the pole (100) onto the extraction bed (88). The size of the extraction bed (88) may be modified by the addition or subtraction of individual extraction bed units (90) in order to compensate for varying lengths of poles (100). In this embodiment, it is anticipated that the extraction bed (88) which support the pole (100) via bed cables (82). This embodiment would provide suitable support for the pole (100) while reducing possible damage to the pole (100) by not being rigid.

Figure 9A:
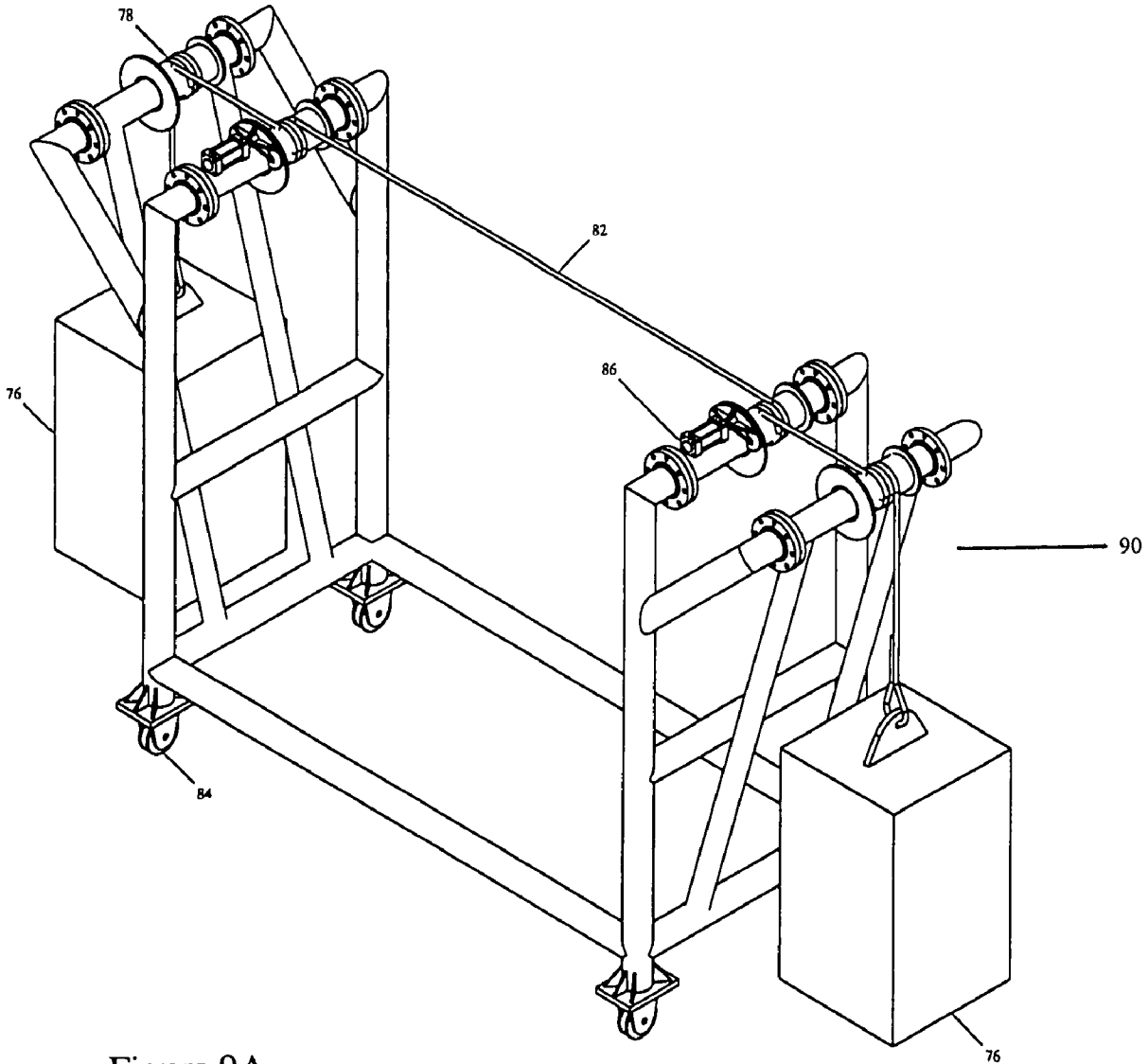
FIG. 9A. is perspective view of a single extraction bed unit.

FIG. 9A. is perspective view of a single extraction bed unit (90), the bed cable (82) goes through the bed pulleys (78) and is connected to the bed counterweight (76). As mentioned in the discussion of FIG. 9., the extraction bed units (90) support the poles (100) by the bed cable (82) which is supported between bed pulley (78) and tensioned by the bed counterweight (76). The bed servomotors (86) are in operable communication with the bed pulleys (78). Because the weight of the pole (100) will be generally known, the bed counterweight (76) can be proportioned in order to accept the expected weight and allow the bed cable (82) to flex while resisting the weight of the pole (100). As the weight of the pole (100) is accepted by the extraction bed (88), each of the extraction bed units (90), bed cables (82) accept the weight of the pole (100) by flexing and engaging the pole (100). The wheels (84) allow both for modification of the size of the extraction bed (88) and engage with the rail (80) (as shown in FIG. 9.) in order to provide for easier removal of the pole (100) from the building (66).

Figure 10:
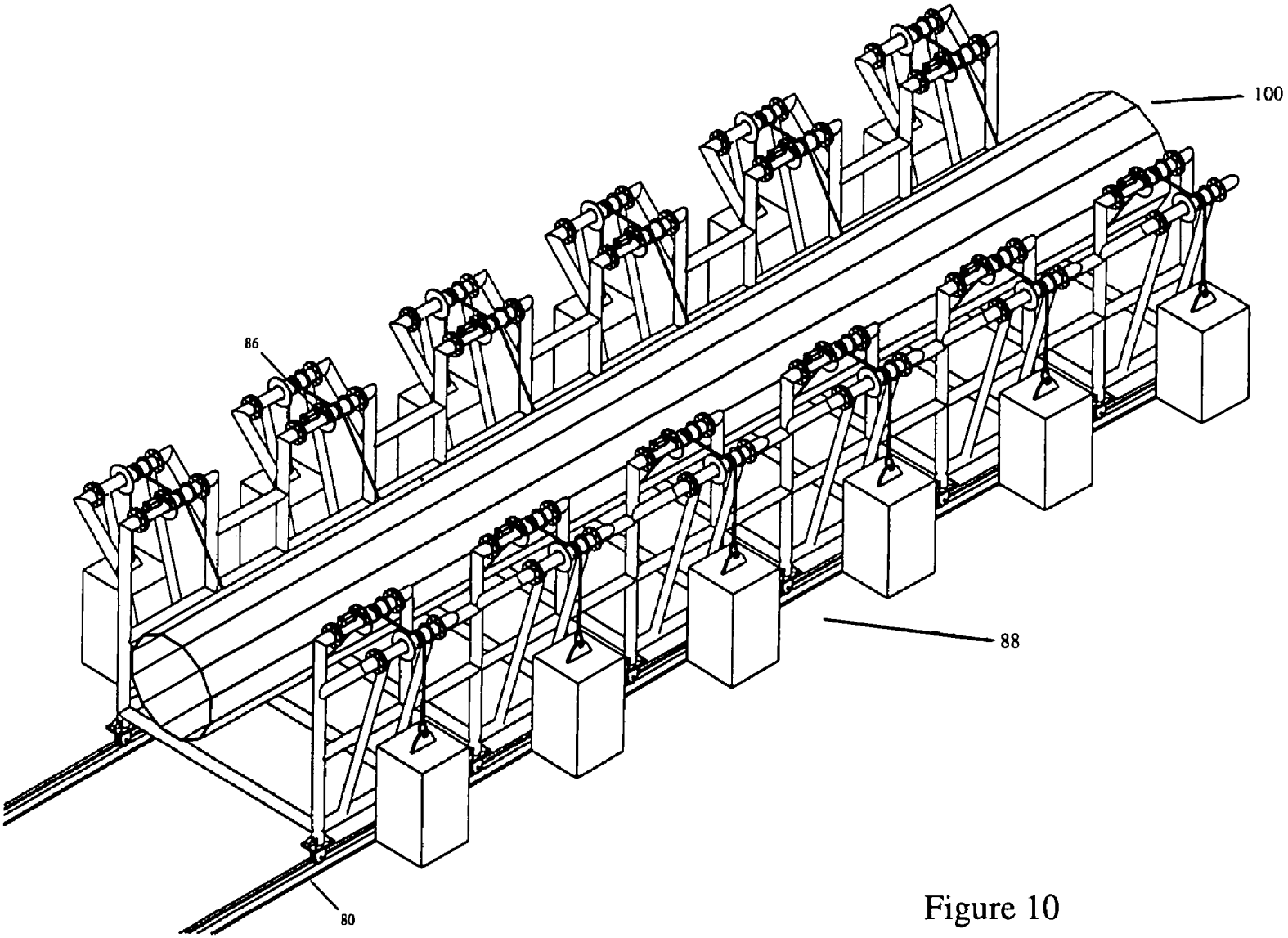
FIG. 10. is perspective view of an extraction bed with a pole in place.

FIG. 10. is a perspective view of the extraction bed (88) with a pole (100) that has been extracted.

Figure 10A:
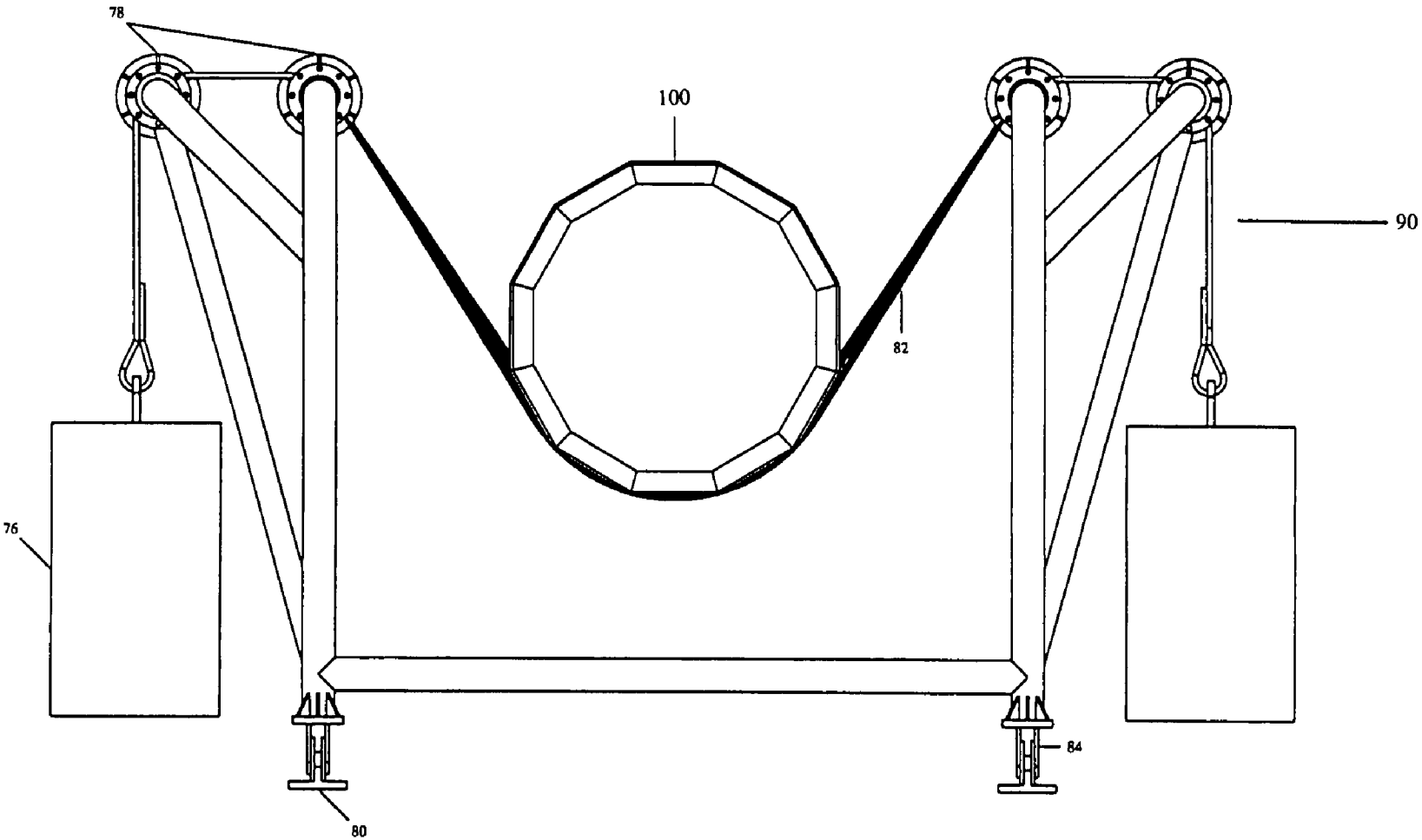
FIG. 10A. is a front view of an extraction bed with a pole in place.

FIG. 10A. is a front view of the pole (100) lying on the extraction bed (88), and shows a single extraction bed unit (90).

Figure 11:
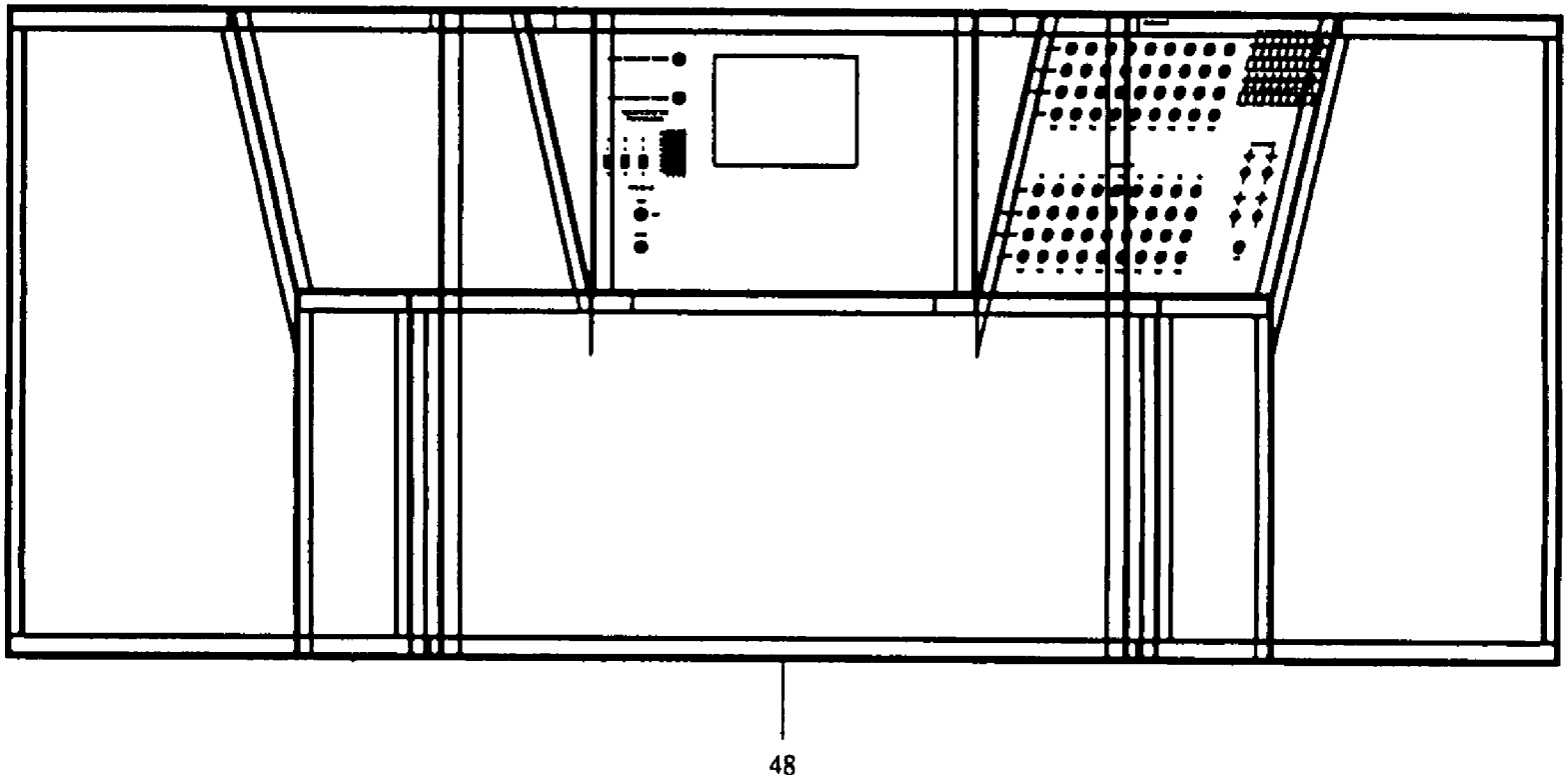
FIG. 11. is a front view of the control panel of the apparatus.

FIG. 11. is a front view of the control panel (54) of the apparatus. It is anticipated that the various attributes of the present invention would be controlled by a user from the control panel (54). The control panel (54) would provide communication between the user and the various components and allow the user to set heights and positioning of the units as well as control welding and extraction.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A pole manufacturing apparatus for manufacturing poles from a multiplicity of pole strips having first ends and second ends and edges, comprising:

a bottom tensioning device, where said bottom tensioning device is removably attachable to said first ends of said multiplicity of pole strips;

a top tensioning device, where said top tensioning device is removably attachable to said second ends of said multiplicity of pole strips;

wherein said bottom tensioning device and said top tensioning device position said multiplicity of pole strips such that each of said edges of said pole strips are adjacent to one edge of another pole strip;

a multiplicity of welding units are attached to a welding platform, said welding platform movable along said pole strips between said bottom tensioning device and said top tensioning device, and where said welding unit is positioned to weld said pole strip edges; and, wherein said bottom tensioning device and said top tensioning device are positioned vertically along a longitudinal axis of said multiplicity of pole strips;

wherein one or both of said bottom tensioning device and said top tensioning device can apply tension along said longitudinal axis of said multiplicity of pole strips; and wherein each of said multiplicity of welding units are positioned to weld a unique joint of said pole strip edges.

2. The pole manufacturing apparatus of claim 1, further comprising:

a top support, wherein said top tensioning device is attached to said top support;

a bottom anchor, wherein said bottom tensioning device is attached to said bottom anchor; and a support column attached to said top support at a first end of said support column, and is attached to said bottom anchor at a second end of said support column.

3. The pole manufacturing apparatus of claim 1, wherein the number of said multiplicity of welding units is equal or greater than the number of pole strips attached to said bottom tensioning device and said top tensioning device.

4. The pole manufacturing apparatus of claim 1, further comprising:

a building surrounding said pole manufacturing apparatus, said building being generally silo shaped; and a door in said side of said building sized to allow for ingress and egress of said manufactured pole.

5. A pole manufacturing apparatus for manufacturing poles from a multiplicity of pole strips having first ends and second ends and edges, comprising:

an extraction platform, where said extraction platform is removably attachable to said first ends of said multiplicity of pole strips;

a top tensioning device, where said top tensioning device is removably attachable to said second ends of said multiplicity of pole strips;

wherein said extraction platform and said top tensioning device position said multiplicity of pole strips such that each of said edges of said pole strips are adjacent to one edge of another pole strip;

a multiplicity of welding units are attached to a welding platform, said welding platform movable along said pole strips between said extraction platform and said top tensioning device, and where said welding is positioned to weld said pole strip edges;

wherein said extraction platform and said top tensioning device are positioned vertically along a longitudinal axis of said multiplicity of pole strips;

wherein one or both of said extraction platform and said top tensioning device can apply tension along said longitudinal axis of said multiplicity of pole strips; and wherein each of said multiplicity of welding units are positioned to weld a unique joint of said pole strip edges.

6. The pole manufacturing apparatus of claim 5, further comprising:

a top support, wherein said top tensioning device is attached to said top support;

a bottom anchor, wherein said extraction platform is attached to said bottom anchor; and a support column attached to said top support at a first end of said support column, and is attached to said bottom anchor at a second end of said support column.

7. The pole manufacturing apparatus of claim 5, wherein the number of said multiplicity of welding units is equal or greater than the number of pole strips attached to said bottom tensioning device and said top tensioning device.

8. The pole manufacturing apparatus of claim 5, further comprising:

a building surrounding said pole manufacturing apparatus, said building being generally silo shaped; and a door in said side of said building sized to allow for ingress and egress of said manufactured pole.

* * * * *